United States Patent [19]

Lark

[11] 3,981,833

[45] Sept. 21, 1976

[54] STARCH/POLYESTER RESIN COMPOSITION

[75] Inventor: John C. Lark, St. Charles, Ill.

[73] Assignee: Standard Oil Company (Indiana), Chicago, Ill.

[22] Filed: Apr. 1, 1975

[21] Appl. No.: 564,025

[52] U.S. Cl. ..... 260/9; 57/140 C; 428/265

[51] Int. Cl.[2] ..... C08L 3/00

[58] Field of Search ..... 260/9; 428/265, 480; 57/140 C

[56] References Cited

UNITED STATES PATENTS

| | | | |
|---|---|---|---|
| 3,086,887 | 4/1963 | Habib | 260/9 |
| 3,484,339 | 12/1969 | Caldwell | 428/480 |
| 3,694,257 | 9/1972 | Dumont | 428/265 |
| 3,712,873 | 1/1973 | Zenk | 260/9 |
| 3,887,752 | 6/1975 | Elizer | 428/480 |

*Primary Examiner*—Edward M. Woodberry
*Attorney, Agent, or Firm*—William H. Magidson; Arthur G. Gilkes; William T. McClain

[57] ABSTRACT

A composition suitable for warp sizing polyester/cotton yarns comprising starch and water soluble polyester resin having (1) a backbone portion comprising the reaction product of polyhydroxy compound and dicarboxylic acid compound wherein from 20 to 75 equivalent percent of the hydroxy groups are provided by a polyoxyethylene glycol having at least 3 oxyethylene units and at least 50 equivalent percent of the dicarboxylic acid compound is provided by an aromatic dicarboxylic acid compound and (2) pendant carboxylic acid moieties comprising a polycarboxylic acid compound having at least 3 acyl moieties which provides from 5 to 30 equivalent percent of the acyl moieties in the polyester.

5 Claims, No Drawings

STARCH/POLYESTER RESIN COMPOSITION

This invention relates to a new sizing composition comprising starch and a polyester of polycarboxylic acid and polyhydric alcohol wherein said polyhydric alcohol comprises polyoxyethylene glycol. More particularly, this invention relates to a warp sizing composition suitable for polyester cotton blends comprising starch and a polyester of polycarboxylic and polyhydric alcohol wherein said polyhydric alcohol comprises polyoxyethylene glycol and said polycarboxylic acid comprises an aromatic dicarboxylic acid and a higher functional polycarboxylic acid.

In the production of textile materials, it is necessary to apply a coating or size to the fibers to protect them from abrasion during the various operations involved in the formation of the cloth. The coating of size must be flexible, tough and normally capable of removal by conventional desizing techniques. The flexibility and toughness are obvious necessities since the fibers, threads or filaments are twisted and bent in various directions and rub against the loom parts. In general, the size must be readily soluble in an aqueous system (dilute aqueous alkali, for example) or else readily digestible by appropriate enzyme desizing agents. Glass fibers can be desized by burning the size off, provided the burnt off size yields a light colored or preferably white ash.

In the case of the so-called hydrophilic fibers, such as cotton, the most commonly used warp sizing agent is starch. This natural polymer is used in many forms, such as the hydrolyzed starches, the dextrins, and the partially etherified or esterified starches. Also, in the case of cotton, such polymers as water-soluble carboxymethyl cellulose, water-soluble hydroxyethyl cellulose and the various natural gums (guar gum, gum arabic, sodium alginate, etc.) have been used.

These warp sizing agents offer little protection to yarn prepared from the so-called hydrophobic fibers, such as nylon, polyesters (polyethylene terephthalate), polyacrylonitrile, cellulose esters (cellulose acetate), fiber glass, etc. This is because the applied coatings do not adhere tenaciously to the hydrophobic fiber and are therefore scraped away by abrasion.

A large number of synthetic fiber sizing agents, which are either water-soluble or dilute alkali-soluble, have been employed to size these hydrophobic fibers with variable success. However, these fiber sizing agents, which include, polyacrylic acid, partially hydrolyzed polymers of acrylonitrile and/or lower alkyl acrylate, maleic anhydride copolymers, maleic acid half-ester copolymers, polyvinyl alcohol, etc., are considerably more expensive than the natural polymeric sizes based on starch.

The various blends of hydrophobic fibers and hydrophilic fibers have led to additional complications, since some warp sizing agents that are suitable for hydrophobic fibers are not suitable for blends. Generally 70% by weight polyvinyl alcohol/30% by weight starch warp sizing compositions have been used commercially for warp sizing the conventional polyester cotton blends because of the relatively good compatability of polyvinyl alcohol and starch, the reduction in cost provided by the starch and relatively good weaving efficiency attainable. Unfortunately, there has been a severe shortage of polyvinyl alcohol recently which has forced mills to use 50/50 blends of starch and polyvinyl alcohol with relatively poor results. Accordingly, there is a need for new starch warp sizing compositions particularly since starch is by far the least expensive sizing agent available.

The general object of this invention is to provide a new warp sizing composition. Another object of this invention is to provide a warp sizing composition comprising starch as the major component suitable for use on polyester cotton blends. Other objects appear hereinafter.

The objects of this invention can be attained with compositions comprising starch and water-soluble polyester resins having (1) a backbone portion comprising the reaction product of polyhydroxy component and a dicarboxylic acid component wherein from 20 to 75 equivalent percent of the hydroxy groups are provided by a polyoxyethylene glycol having at least 3 oxyethylene groups, preferably 5 to 30 equivalent percent of the hydroxy groups are provided by a polyhydroxy component having at least 3 hydroxy moieties, and at least 50 equivalent percent of the dicarboxylic acid component are provided by an aromatic dicarboxylic acid compound and (2) pendant carboxylic acid moieties comprising a polycarboxylic acid compound having at least three acyl moieties wherein said polycarboxylic acid compound having at least three acyl moieties provides from 5 to 30 equivalent percent of the acyl moieties in the polyester. The polyoxyethylene glycol component is necessary to make the polyester resin compatible with the starch film and improves the flexibility of the starch film. If more than 75 equivalent percent of the hydroxyl groups in the polyester resin are provided by the polyoxyethylene glycol having at least three oxyethylene units, the coating tends to be too hydrophilic and does not adhere well to the polyester/cotton yarns. The aromatic polycarboxylic acid compounds seem to be necessary to obtain optimum adhesion to the polyester/cotton yarns. The pendant carboxyl groups and oxyethylene units in the polyoxyethylene glycol together are primarily responsible for the water-solubility of the polyester resin in the aqueous coating bath and the removability of the warp size after weaving in suitable alkaline desizing baths.

Briefly, the water-soluble polyester resins useful in this invention can be produced by reacting substantially all of the polyhydroxy components and all of the dicarboxylic acid components to form the backbone polyester having an acid number of about 0 to 25 and then polycarboxylic acid compound having at least 3 acyl moieties is condensed to form a polyester resin having an acid number of at least 35, preferably 35 to 70.

The polyoxyethylene glycols useful in this invention can contain from 3 to about 150 oxyethylene units such as triethylene glycol, tetraethylene glycol, pentaethylene glycol, Carbowax 600, Carbowax 1540, etc. The polyoxyethylene glycols having on an average from about 10 to 40 oxyethylene units impart the best balance of properties to the polyester resin (e.g. compatibility with starch, adhesion to the polyester/cotton yarn, removeability in desizing baths, etc). If the polyoxyethylene glycol comprises less than 20 percent of the hydroxyl equivalents in the polyester resin, the polyester resin has less compatability with the starch component and if it comprises above about 75 percent of the hydroxyl equivalents the polyester resin lacks adhesion to the polyester component of the polyester/cotton yarn. Correspondingly from 80 to 25 equivalent percent of the hydroxyl equivalents in the polyester resin can be provided by other dihydroxyl compounds, such as alpha, omega alkylene glycol containing 2 to 12 carbon atoms (e.g. ethylene glycol, trimethylene glycol, tetramethylene glycol, dodecamethylene glycol, etc.), 1,2-alkylene glycols containing 3 to 12 carbon atoms (e.g. 1,2-propylene glycol, etc.), neopentyl glycol, diethylene glycol, etc. and polyhydroxy compounds containing 3 to 6 hydroxy groups, such as 1,1,1-trimethylol ethane, 1,1,1-trimethylol propane, glycerol, 1,2,6-hexanetriol, pentaerythritol, sorbitol etc. Adhesion of the polyester resin/starch composition to polyester/cotton yarn is enhanced when the polyhydroxy compound having 3 to 6 hydroxy groups comprises from 5 to 30 percent of the hydroxyl equivalents in the polyester resin. In such cases the dihydroxy compounds other than the polyoxyethylene glycol having 3 oxyethylene units comprises from 0 to 75 percent of the hydroxyl equivalents in the polyester resin.

Suitable aromatic dicarboxylic acid compounds in the backbone portion of the polyester resin include benzene dicarboxylic acid compounds such as phthalic acid, phthalic anhydride, isophthalic acid, terephthalic acid, etc; naphthalene dicarboxylic acid, particularly the 2,6 dicarboxylic acid, etc. Up to 50 equivalent percent of the acyl equivalents in the backbone portion of the polyester can be provided by saturated aliphatic and cycloaliphatic dicarboxylic acids such as adipic acid, sebacic acid, suberic acid, dimer acid, etc. which provide additional flexibility to the polyester resin/-starch coatings.

Suitable pendant polycarboxylic acid compounds having at least three carboxyl or acyl groups include trimellitic anhydride, trimellitic acid, trimesic acid, pyromellitic acid, etc. These acids should not be included in the backbone portion of the polyester resin since they tend to lead to premature gellation of the polyester resin. The pendant polycarboxylic acids contribute to the water-solubility of the polyester resin and the removeability from yarns in alkaline desizing baths. Further, the aromatic nucleus of these acids seems to help in the adhesion of the polyester resin composition to the polyester yarn blends.

In somewhat greater detail the backbone polyester having an acid number of about 0 to 25 can be produced by condensing substantially all of the polyhydric alcohols and substantially all of the dicarboxylic acid compounds. The hydroxyl:carboxyl ratio must be more than 1 in order to provide terminal or internal hydroxyl groups in the polyester for reaction in the second stage with the polycarboxylic acid compound having at least 3 acyl groups. After the polyester backbone having an acid number of about 0 to 25 is produced, the polycarboxylic acid compound having at least three acyl groups is condensed in the second stage to provide a water-soluble polyester having an acid number of at least 35, preferably 35 to 70. Typically, the preferred backbone polyester is formed by condensing the reactants at 300° to 500°F. until the polyester has an acid humber of 0 to 25, and then a trimellitic acid compound is reacted at 250° to 480° until a polyester having an acid number of at least 35 is formed.

Any of the polyesters of this invention can be dissolved in water or aqueous medium containing co-solvent or in co-solvent and/or base prior to blending with the starch. Suitable co-solvents include alcohols, such as butanol, pentanol, diethylene glycol monomethyl ether, propylene glycol monopropyl ether, etc. Suitable bases include ammonia, morpholine, alkali metal (sodium or potassium) hydroxides, etc.

For the purposes of this invention, the term "starch" is used in a generic sense to include a naturally occurring starch, a modified starch, or a derivative of starch. Corn starch, tapioca starch, rice starch, potato starch, wheat starch, and the amylose and amylpectin fractions therefrom are representative of the various native starches and starch fractions that can be used. Any of these starches may be modified by enzyme treatment, by oxidation with hypochlorite or by heating with an acid or be derivatized by treatment with alkylene oxide, such as ethylene oxide or propylene oxide, acrylonitrile, partially esterified with an esterifying agent such as vinyl acetate or acetic anhydride. The starch derivatives also include carboxymethyl starch, carboxyethyl starch, N,N-diethylaminoethyl starch and other starch esters and ethers that can be used as sizing agents.

Just prior to use, the granular or pregelatinized starch is slurred in water at the desired concentration (1 to 25% by weight). The starch is pasted either by batch means or in a continuous starch cooker (e.g., Votator) and then the paste is mixed with the polyester resin. A weight ratio of 0.1 to 100 parts by weight, preferably 5 to 25 parts by weight, polyester resin solids per each 100 parts by weight starch solids can be used. For the most part, it is desirable to use as low a concentration of polyester as possible. After the polyester/cotton yarn is warp sized and woven, the resultant textile can be desized in dilute aqueous alkali.

While compositions of this invention can be used to warp size polyester/cotton yarn blends containing from 30 to 85% by weight polyester, they can also be used to warp size 100% polyester spun yarn, polyester/wool blends, cotton, etc.

The following examples are merely illustrative and should not be construed as limiting the scope of the invention:

EXAMPLE 1

A polyester suitable for use in this invention was prepared by adding 2.25 mole isophthalic acid, .45 mol adipic acid, 1.2 mol Carbowax 600, 1.20 mol neopentyl glycol and .3 mol 1,1,1-trimethylolpropane to a kettle equipped with reflux condenser, thermometer and nitrogen sparge. The composition was heated to 350°F over a period of 2 hours and then to 450°F for over the next hour. The reactor pot temperature was maintained at 450°F for a total of 12 hours at which time the acid number of the polyester resin had reached 15.0. After the polyester, having an acid number of 15.0, was cooled to 350°F, .30 mol trimellitic anhydride was added to the reactor and the reactor temperature was maintained at 350° to 360°F for a period of 40 minutes to provide a polyester having an acid number of 38 to 41. The polyester was cooled to room temperature and dissolved in Propasol P (1,2-propylene glycol monopropyl ether) to form an 80% solid solution, neutralized to pH 5.8 to 6.5 with concentrated ammonium hydroxide and then reduced to 30% solids with water.

A 10% solids aqueous starch composition was produced by pasting 10 parts by weight (dry solids basis) National Starch Flogel 40 (acid modified starch having 40 fluidity) with 90 parts by weight water in a laboratory steam cooker for a period of 30 minutes at 205°F. to 210°F. After the starch paste was cooled to 150° to 160°F, 1.2 parts dry weight of the 30% solid resin prepared in the preceding paragraph was added with stirring. The composition at 150° to 160°F was then applied with a draw down bar applicator to a Mylar (polyester film) and allowed to dry for a period of 12 to 14 hours at a humidity of at least 60% R.H. A 10% solids starch composition containing no polyester was also applied to Mylar film in the same manner. The adhesion of the starch films to the substrate was checked by bending the coated films. The 100% starch film separated and flaked from the polyester film on bending while the polyester/starch composition exhibited no flaking from the polyester during vigorous bending. Accordingly, the starch/polyester resin compositions of this invention have excellent adhesion to polyester substrates.

Essentially the same results were attained when the starch composition was applied from a 5% paste containing 12% polyester resin (dry solids basis) based on the dry weight of the starch.

EXAMPLES 2 TO 9

In the examples that follow all of the polyester resins were prepared in the manner described in Example with all of the dicarboxylic acid compounds and polyhydric alcohols condensed in the first stage and the trimellitic acid condensed in the second stage. The polyester resins were formulated with the 10% solids starch pastes in the manner described in Example 1 and evaluated in the same manner on polyester film. The number of equivalents of polyester components is set forth in Table I.

Table II

| Example No. | 2 | 3 | 4 | 5 | 6 | 7 | 8 | 9 |
|---|---|---|---|---|---|---|---|---|
| | Equivalents of Reactants | | | | | | | |
| Isophthalic acid | 4.5 | 4.5 | 4.5 | 5.4 | 5.4 | 2.7 | 2.24 | 4.5 |
| Adipic Acid | .9 | .9 | | | | .45 | .44 | .9 |
| Carbowax 600 | 2.4 | 2.4 | 2.4 | 2.4 | 2.4 | | | 2.4 |
| Carbowax 1540 | | | | | | 1.2 | 1.2 | |
| Neopentyl Glycol | | 2.4 | | | 2.4 | | 1.2 | 3.3 |
| Ethylene Glycol | 2.4 | | | | | | | |
| Diethylene Glycol | | | | 2.4 | | | | |
| Trimethylol Propane | .9 | | .9 | .9 | .9 | .45 | .45 | |
| Glycerol | | .9 | | | | | | |
| Trimellitic Anhydride | .9 | .9 | .9 | .9 | .9 | .45 | .45 | .9 |
| Dimer Acid | | | .9 | | | .6 | .6 | |

Coatings prepared from the polyester resins of Examples 2 to 4 on polyester film exhibited no flaking from the polyester film during vigorous bending and creasing of the polyester film samples. Coatings prepared from the polyester resins of Examples 5 to 9 displayed slight cracking and some flaking during vigorous bending and creasing of the polyester film sample. In all cases there was markedly better adhesion to polyester films than when starch was used alone.

EXAMPLE 10

This Example illustrates the use of the polyester resin of Example 1 as a warp size. Polyester/cotton 50/50 spun yarn was warp sized under conventional commercial conditions using a 15% dry solids starch paste (Hubsize 177, which is an acid modified 19 fluidity corn starch) and 12 parts by weight dry solids polyester resin of Example 1 per each 100 parts by weight dry starch to provide a 14½ to 15% weight pick up by the yarn. Weaving efficiency with this composition was 93%.

I claim:

1. A composition comprising pasted starch and water soluble polyester resin having an acid number of at least 35 comprising (1) a backbone portion having an acid number of from 0–25 comprising the reaction product of polyhydroxy compound and dicarboxylic acid compound having a hydroxyl:carboxyl ratio of more than one wherein from 20 to 75 equivalent percent of the hydroxy groups are provided by a polyoxyethylene glycol having at least 3 oxyethylene units and at least 50 equivalent percent of the dicarboxylic acid compound is provided by an aromatic dicarboxylic acid compound and (2) pendant carboxylic acid moieties comprising a polycarboxylic acid compound having at least 3 acyl moieties which provides from 5 to 30 equivalent percent of the acyl moieties in the polyester, wherein said polyester resin comprises from 0.1–100 parts by weight per each 100 parts by weight starch.

2. The composition of claim 1 wherein from 5 to 30 equivalent percent of the hydroxyl groups in the polyester are provided by polyhydroxy compound having at least 3 hydroxy moieties.

3. The composition of claim 2 wherein said polyoxyethylene glycol contains on an average from about 10 to 40 oxyethylene units.

4. The composition of claim 2 wherein up to 50 equivalent percent of the acyl equivalents in the backbone portion of the polyester are provided by saturated aliphatic and cyclic aliphatic dicarboxylic acids.

5. The compositions of claim 2 wherein said pendant polycarboxylic acid compound comprise a trimellitic acid compound.

* * * * *